United States Patent [19]

Riemersma

[11] Patent Number: 4,490,905

[45] Date of Patent: Jan. 1, 1985

[54] SHAVING APPARATUS

[75] Inventor: Pieter Riemersma, Drachten, Netherlands

[73] Assignee: U.S. Philips Corporation, New York, N.Y.

[21] Appl. No.: 458,797

[22] Filed: Jan. 18, 1983

[30] Foreign Application Priority Data

Feb. 9, 1982 [NL] Netherlands ..... 8200479

[51] Int. Cl.[3] ..... B26B 19/26

[52] U.S. Cl. ..... 30/34.1

[58] Field of Search ..... 30/34.1

[56] References Cited

U.S. PATENT DOCUMENTS 3,911,572 10/1975 Czerner et al. ..... 30/34.1

3,991,464 11/1976 Ihasz ..... 30/34.1

FOREIGN PATENT DOCUMENTS 135063 10/1979 Japan ..... 30/34.1

827768 2/1960 United Kingdom ..... 30/34.1

*Primary Examiner*—Jimmy C. Peters

*Attorney, Agent, or Firm*—Rolf E. Schneider

[57] ABSTRACT

A shaving apparatus having a housing includes a trimmer movable relative to the housing between a latched position and an operating position. The trimmer comprises a holder, a pair of cutters arranged in the holder, and a slidable actuating button associated with the holder. A connecting element is secured to the actuating button and has oppositely extending resilient arms, the distal end of each such arm being formed as a latching member engageable behind a wall portion of the housing to hold the trimmer in the latched position. Each latching member has a cam surface inclined relative to the direction of movement of the actuating button and cooperative with the holder. The latching members are disengaged from the respective wall portions of the housing to release the trimmer for movement to the operating position upon movement of the actuating button.

2 Claims, 4 Drawing Figures

SHAVING APPARATUS

This invention relates to a shaving apparatus having a trimmer which comprises a holder and cutters and is movable relative to the housing of the shaving apparatus between a latched position and an operating position.

Such a shaving apparatus is known from, for example, British Pat. No. 827,768. It is the object of the present invention to reduce the number of components required for such a construction and, in general, to simplify its manufacture.

The construction in accordance with the invention is characterized in that the trimmer is provided with a slidable actuating button to which is connected at least one resilient arm having a cam surface which is inclined relative to the direction of movement of the actuating button and which is cooperative with the holder, the free end of said arm comprising a latching member which is engageable behind a wall portion of the housing to hold the trimmer in the latched position, the arm being movable through cooperation between said cam surface and the holder by sliding the actuating button so that the latching member is disengaged from the wall portion of the housing to release the trimmer for movement to the operating position.

A preferred embodiment is characterized in that the trimmer comprises two of said resilient arms and the latching members of the arms are engageable behind wall portions of the housing of the shaving apparatus, the resilient arms being integral with a connecting member to which the actuating button is secured.

An embodiment which is easy to assemble is characterized in that the trimmer is pivotally connected to said wall portions of the housing of the shaving apparatus and forms a detachable unit with said wall portions.

The invention will now be described in more detail with reference to the accompanying drawings, in which.

Figure 1:
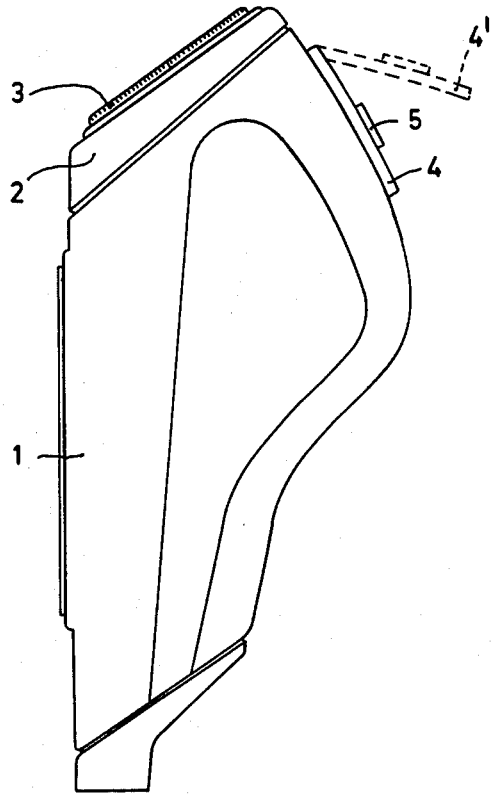
FIG. 1 is a side elevation of a shaving apparatus provided with a trimmer.

The shaving apparatus shown in FIG. 1 comprises a housing 1 having a shaving head 2 containing shaving members 3. The shaving apparatus is provided with a trimmer 4 which can be swung from a latched position into an operating position, as indicated by the broken lines 4' in FIG. 1. By means of an actuating button 5 the trimmer can be released for movement from the latched position to the operating position.

Figure 2:
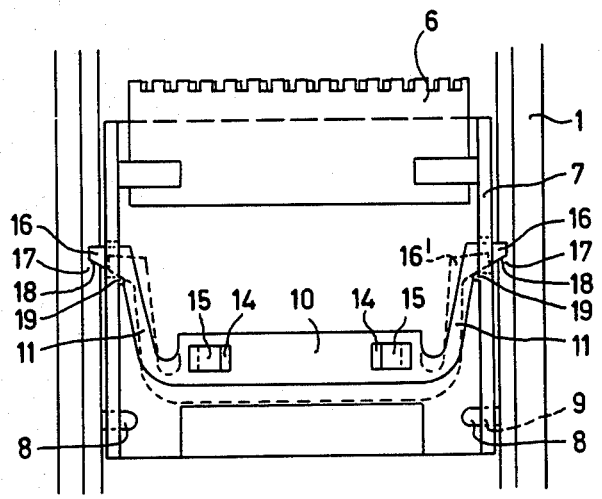
FIG. 2 is a view of the inner side of the trimmer and a part of the housing of the shaving apparatus.
Figure 3:
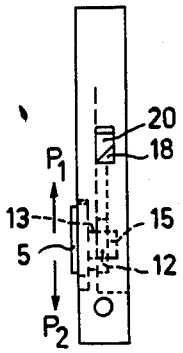
FIG. 3 is a side view of the trimmer shown in FIG. 2.
Figure 4:
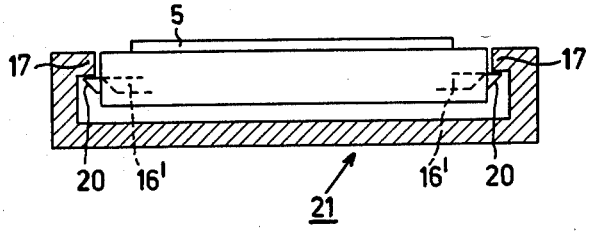
FIG. 4 is a plan view of the detail shown in FIG. 2.

FIGS. 2 to 4 each show the trimmer, which mainly comprises a pair of cutters 6 arranged in a holder 7. By means of pins 8 on the housing 1 which engage in holes 9 in the holder 7 the trimmer is pivotally connected to the housing 1 of the shaving apparatus. One of the cutters of the pair of cutters 6 can be reciprocated relative to the other cutter in a manner which is known per se and which is not shown in the drawings.

The actuating button 5, which can be slid in the directions P1 to P2 relative to the holder, is secured to a basically U-shaped connecting element or member 10 disposed on the inner side of the holder 7, which member includes oppositely extending resilient arms 11. The actuating button 5 has hook-shaped lugs 12 which extend through elongate openings 13 in the holder and openings 14 in the connecting member 10 and whose hooked ends 15 engage behind the connecting member 10. Latching members 16 formed on the distal ends of the arms 11 project from the sides of the holder 7 and engage behind wall portions 17 of the housing of the shaving apparatus to hold the trimmer in the latched position. The latching members 16 have cam surfaces 18 which are inclined relative to the directions of movement $P_1$ and $P_2$ of the actuating button 5.

By moving the actuating button 5 in the direction $P_2$ the member 10, with the resilient arms 11, will be moved in the same direction. During this movement the cam surfaces 18 slide on wall portions 19 of the holder 7, and as a result of the inclination of the cam surfaces 18 the resilient arms 11 are urged towards each other so that the latching members 16 are moved inwards to the position designated 16', and are thereby disengaged from the wall portions 17 of the housing 1.

Under the influence of a spring, not shown, the trimmer is now swung into the operating position.

The latching members also have inclined cam surfaces 20 so that the latching members are also urged inwards when the trimmer is swung from the operating position into the latched position. The latching members 16 then snap behind the wall portions 17 of the housing 1.

The trimmer described in the foregoing comprises only a small number of components which, in addition, may be manufactured simply, for example, by injection-moulding from a plastic. Assembly of the components is also simple and therefore cost-saving. This is especially so if the trimmer 4, together with the wall portions 17 of the housing 1 of the shaving apparatus, forms a detachable unit 21 (FIG. 4) which can be mounted separately.

What is claimed is:

1. A shaving apparatus having a housing and including a trimmer movable relative to said housing between a latched position and an operating position; said trimmer comprising a holder, a pair of cutters arranged in said holder, a slidable actuating button associated with the holder, and a connecting element secured to said actuating button and having oppositely extending resilient arms, the distal end of each such arm being formed as a latching member engageable behind a wall portion of the housing to hold the trimmer in the latched position, each latching member having a cam surface inclined relative to the direction of movement of the actuating button and cooperative with the holder, the latching member being disengaged from the respective wall portions of the housing to release the trimmer for movement to the operating position upon movement of the actuating button.

2. A shaving apparatus according to claim 1, in which the trimmer is pivotally connected to said wall portions of the housing and forms a detachable unit with said wall portions.

* * * * *